United States Patent [19]

Beatty et al.

[11] 4,164,186

[45] Aug. 14, 1979

[54] SUBMARINE SIGNAL FUZE

[75] Inventors: Bobby D. Beatty, Bloomfield; Russell D. Daniel, Bloomington; Billy J. Humerickhouse, Odon, all of Ind.

[73] Assignee: The United States of America as represented by the Secretary of the Navy, Washington, D.C.

[21] Appl. No.: 844,328

[22] Filed: Oct. 21, 1977

[51] Int. Cl.[2] ..... F42B 4/26

[52] U.S. Cl. ..... 102/37.8; 102/207; 102/263

[58] Field of Search ..... 102/7, 16, 37.8, 207, 102/263

[56] References Cited

U.S. PATENT DOCUMENTS

| | | | |
|---|---|---|---|
| 1,370,193 | 3/1921 | Crocker | 102/16 |
| 1,441,744 | 1/1923 | Palmer | 102/16 |
| 3,048,111 | 8/1962 | Baker | 102/229 |
| 3,169,479 | 2/1965 | Bryan | 102/24 |
| 3,185,090 | 5/1965 | Weber | 102/49.5 |
| 3,196,789 | 7/1965 | Fasig | 102/7 |
| 3,199,453 | 8/1965 | Fasig | 102/263 |
| 3,262,387 | 7/1966 | Reams | 102/263 |
| 3,362,333 | 1/1968 | Czajkowski | 102/16 |
| 3,766,858 | 10/1973 | Handler | 102/7 |
| 3,839,984 | 10/1974 | Hinves | 102/16 |
| 4,050,382 | 9/1977 | Power | 102/16 |
| 4,056,058 | 11/1977 | deRins | 102/1 C |

*Primary Examiner*—Samuel W. Engle
*Assistant Examiner*—Edward F. Miles
*Attorney, Agent, or Firm*—R. S. Sciascia; Paul S. Collignon

[57] ABSTRACT

A signaling device to be launched underwater having a fuze body and a projectile containing pyrotechnic compositions. The pyrotechnic compositions are ignited by an electrical squib which is detonated by voltage from a sea water battery which is sealed from sea water until a valve opens to permit entry of water into the fuze. An open circuit is provided between the battery and leads of the squib and, in addition, the squib leads are shorted. The opening of a valve to permit entry of sea water into the fuze causes the short to be removed and closes the circuit between the battery and the squib.

3 Claims, 8 Drawing Figures

OPEN CIRCUIT WITH SQUIBS SHORTED OUT

CLOSED CIRCUIT WITH SQUIB WIRES NOT SHORTED OUT

SUBMARINE SIGNAL FUZE

BACKGROUND OF THE INVENTION

The present invention relates to a submarine signaling device and more particularly to a signaling device containing a pyrotechnic composition and which is launched from a submerged submarine.

Submarines have used pyrotechnic signals as a means of providing a mark on the ocean surface in order to show the relative position of the submarine to surface ships. Heretofore, most signal devices have been provided with a fixed time delay which permits the signal to rise to the surface before the pyrotechnic is ignited. However with the advent of nuclear submarines, which can operate faster and at greater depths, the fixed time delay device is no longer adequate as the submarine may travel a great distance between the time of launch and the time of ignition of the pyrotechnic device.

In order to overcome the disadvantages of the fixed time delay type device, devices have been provided that operate by pressure and are actuated upon reaching a predetermined depth. One such device is shown in U.S. Pat. No. 3,048,111 which issued Aug. 7, 1962, to Baker et al. This patent shows an arming and firing mechanism which operates through progressive steps and is actuated by changing pressure of the water medium through which it is launched. A relatively high hydraulic pressure is first used to align a portion of a firing pin and then a low pressure is used to actuate another portion of the firing pin which then strikes that portion which was placed in alignment. While this patent does provide the desired function, that is, the pyrotechnic is ignited upon the signal fuze reaching the surface, nevertheless the complicated mechanism is expensive to build and the complicated mechanism can result in malfunctioning.

In U.S. Pat. No. 3,196,789, which issued July 27, 1965, to Stanley M. Fasig and Glenn C. Johnson, another submarine signaling device is shown and described which operates similar to the Baker et al device in that the pyrotechnic composition is not ignited until the signal reaches the surface of the water. A sea water battery is provided and, upon the signal reaching the surface, the battery is ejected into the sea and the water, acting as an electrolyte, energizes the battery plates.

In U.S. Pat. No. 3,199,453, which issued Aug. 10, 1965 to Stanley M. Fasig and Glenn C. Johnson, still another submarine signaling device is disclosed which also uses a sea water battery and, upon the signal reaching the surface, a valve is opened which permits the battery compartment to be flooded and the sea water, acting as an electrolyte, energizes the battery plates.

SUMMARY OF THE INVENTION

The present invention is for a signaling device which is launced underwater and has a fuze body and a projectile containing pyrotechnic compositions. The present invention is similar to the devices described in the two above-referenced patents to Fasig and Johnson, in that a sea water battery is used to detonate one or more squibs which then ignite the pyrotechnic compositions. A circuit is provided between the battery and squibs and is normally opened. In addition, the leads of the squib are shorted. A valve is provided which opens upon the signaling device reaching the surface and opening of the valve closes the circuit between the battery and squibs and also removes the short from the squib leads.

It is therefore, a general object of the present invention to provide an improved submarine signal fuze that can be launched from various depths but will not be ignited until the signal fuze reaches the surface.

Another object of the present invention is to provide a submarine signal fuze that is actuated upon a compartment being flooded whereupon sea water energizes a battery.

Still another object of the present invention is to provide safety circuits between a sea water battery and an electrical squib which prevent accidental ignition of a pyrotechnic device.

Other objects and advantages of the present invention will be readily appreciated as the same becomes better understood by reference to the following detailed description when considered in connection with the accompanying drawings.

DESCRIPTION OF THE PREFERRED EMBODIMENT

Figure 1:
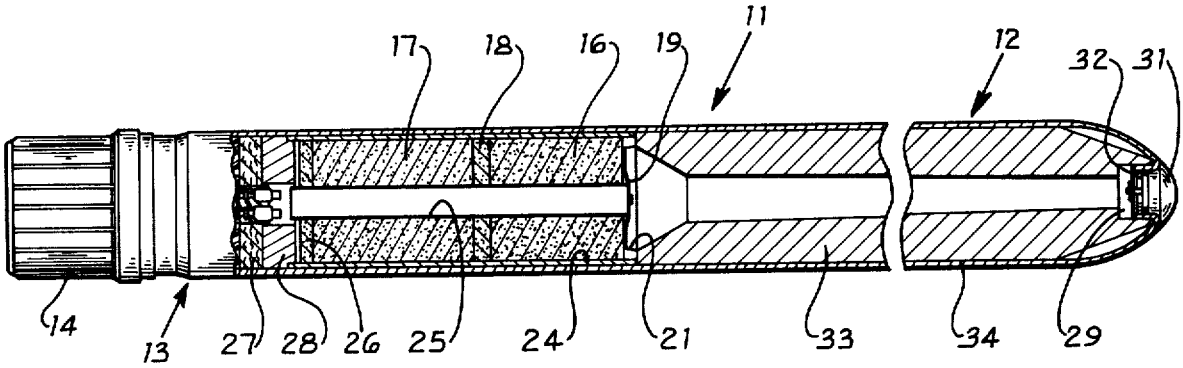
FIG. 1 is a longitudinal view, partly in section of a preferred embodiment of the present invention.
Figure 2:
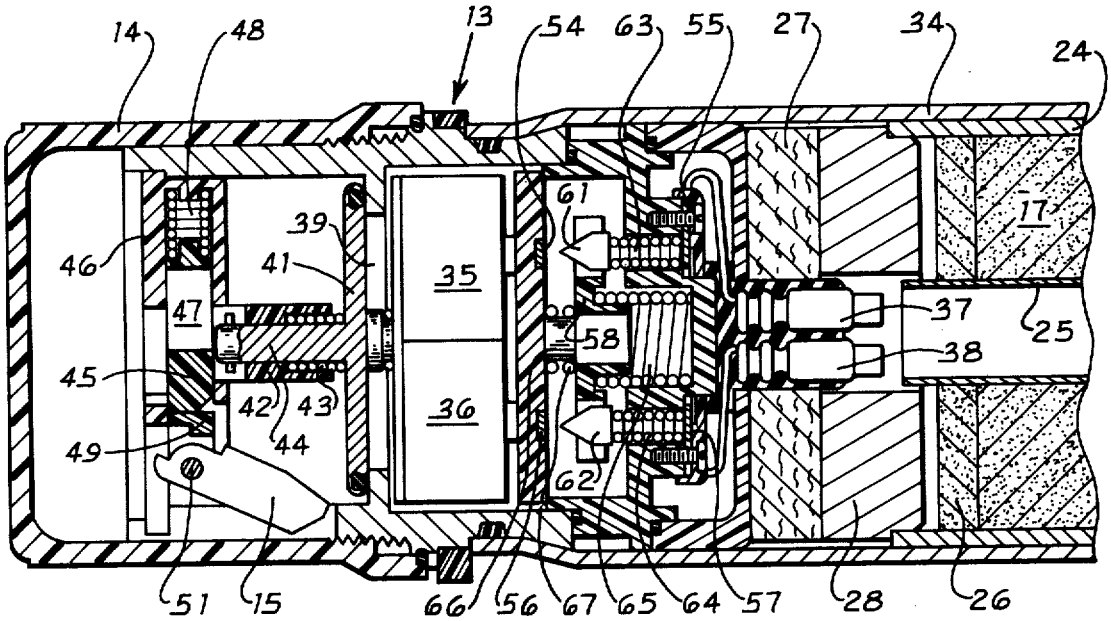
FIG. 2 is an enlarged sectional view of the fuze section of the present invention.

Referring now to the drawings and particularly to FIGS. 1 and 2, there is shown a signaling device 11 consisting of a projectile 12 and a fuze body 13. Projectile 12 is attached to fuze body 13 by crimping and a plastic cover 14 is threadedly attached to fuze body 13 to lock a trip lever 15 and provide protection for fuze body 13. Cover 14 must be removed prior to launching signal device 11. Projectile 12 contains a smoke composition 16 and a flare composition 17 which are separated by a transfer composition 18. An ignition disc 19, such as Z-2 paper, is placed adjacent one end of smoke composition 16 to assist in the ignition of the smoke composition 16. Ignition disk 19 is held in position by a retainer 21. By way of example, smoke composition 16 and flare composition 17 might both emit, upon burning, green smoke and flame or might both emit, upon burning, yellow smoke and flame.

The following smoke and flare formulas are submitted, by way of example:

COMPOSITION FOR GREEN SMOKE

| | %, by Weight |
|---|---|
| Green dye mix | $50^{\pm 5}$ |
| Potassium chlorate | $24^{\pm 5}$ |
| Sugar | $16^{\pm 3}$ |
| Baking soda | $4.5^{\pm 2}$ |
| Diatomaceous earth | $5.5^{\pm 2}$ |

The green dye mix consists of:

-continued

| | |
|---|---|
| Solvent green dye | $70^{\pm 3}$ |
| Benzanthrone dye | $20^{\pm 1}$ |
| Vat yellow dye | $10^{\pm 1}$ |
| COMPOSITION FOR GREEN FLARE | |
| | %, by Weight |
| Copper powder | $7^{\pm 1}$ |
| Magnesium powder | $22^{\pm 2}$ |
| Potassium perchlorate | $30^{\pm 3}$ |
| Barium nitrate | $23^{\pm 1.5}$ |
| Polyvinyl chloride | $12^{\pm 3}$ |
| Asphaltum | $1.5^{\pm 0.5}$ |
| Binder | $4.5^{\pm 0.25}$ |
| COMPOSITION FOR YELLOW SMOKE | |
| | %, by Weight |
| Yellow dye mix | $53^{\pm 5}$ |
| Potassium chlorate | $23^{\pm 2}$ |
| Sugar | $14^{\pm 3}$ |
| Baking soda | $4.5^{\pm 3}$ |
| Diatomaceous earth | $5.5^{\pm 2}$ |
| The yellow dye mix consists of: | |
| Vat yellow dye | $55^{\pm 1}$ |
| Benzanthrone dye | $45^{\pm 1}$ |
| COMPOSITION FOR YELLOW FLARE | |
| | %, by Weight |
| Magnesium powder | $30^{\pm 3}$ |
| Potassium perchlorate | $27^{\pm 7}$ |
| BArium nitrate | $23^{\pm 5}$ |
| Sodium oxalate | $14^{\pm 2}$ |
| Asphaltum | $2^{\pm 0.5}$ |
| Binder | $4^{\pm 0.25}$ |

Transfer composition 18 is placed between smoke composition 16 and flare composition 17 to facilitate the ignition of flare composition 17. As best shown in FIG. 1 of the drawings, smoke composition 16, flare composition 17, and transfer composition 18 are pressed into a candle tube 24 and a center tube 25 passes through the three compositions. The forward end of candle tube 24 is closed by ignition disc 19 and retainer 21 and the aft end of candle tube 24 is closed with fire clay 26. A compression pad 27 and ballast 28 are provided between the end of candle tube 24 and fuze body 13. The forward nose of projectile 12 is provided with an orifice 29 and a nose plug 31 closes orifice 29 and is held in place by a retaining disc 32. A chimney 33 is positioned between candle tube 24 and orifice 29 and, by way of example, might be made of phenolic foam. In addition to providing a passage for smoke and flame, chimney 33 also provides support for the outer tube 34 of projectile 12.

Figure 3:
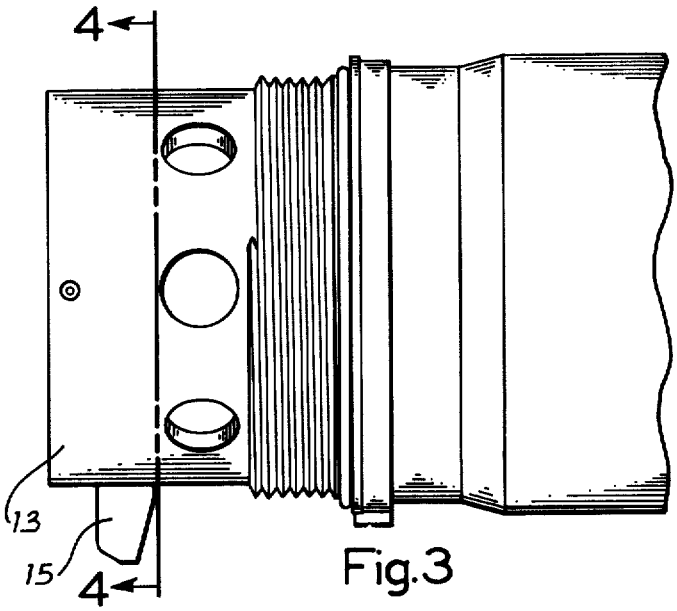
FIG. 3 is a partial view showing an aft end of the present invention.
Figure 4:
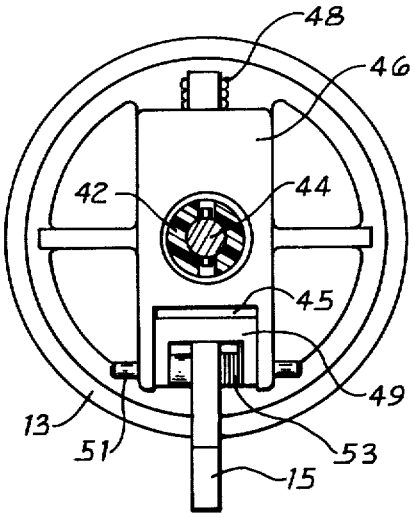
FIG. 4 is a sectional view taken on line 4—4 of FIG. 3.

Referring now particularly to FIG. 2 of the drawings, two sea water batteries 35 and 36 are positioned within fuze body 13 and are connected through circuitry to separate electric squibs 37 and 38. By way of example, batteries 35 and 36 might be of a single cell construction with the negative plate being of magnesium and the positive plate being comprised of a film of silver chloride on a silver plate. Squibs 37 and 38 are centered with center tube 25 so that detonation of these squibs causes flame and heat to pass through center tube 25 and ignite ignition disk 19. An opening 39 is provided in fuze body 13 and valve 41 is provided to close opening 39 and prevent sea water from energizing batteries 35 and 36. A collar 42 and spring 43 are provided around a stem 44 on valve 41 and a slider 45, which is slidably mounted in a housing 46, retains collar 42 and spring 43 in a locked position whereby spring 43 is compressed and provides a force for keeping valve 41 tightly closed. Slider 45 has a clearance hole 47 for releasing collar 42 and a spring 48 is positioned in housing 46 for moving slider 45. A U-shaped latch 49 is pivotally mounted on shaft 51 which also pivotally supports trip lever 15. As shown in FIG. 2 of the drawings, trip lever 15 is pivoted upwardly to permit cover 14 to be threaded with fuze body 13 and, when cover 14 is removed, spring 53, which is mounted around shaft 51, moves latch 49 to a tripping position, as shown in FIGS. 3 and 4 of the drawings.

Figure 7:
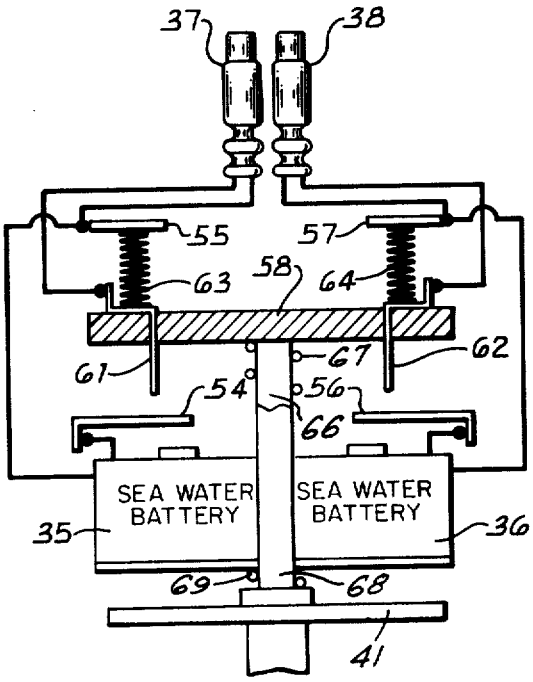
FIG. 7 is a circuit diagram showing an opened circuit and a shorted condition.
Figure 8:
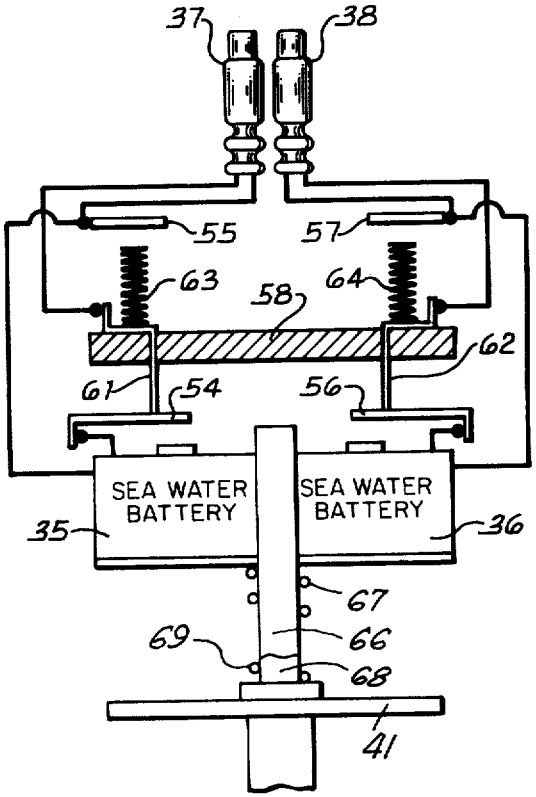
FIG. 8 is a circuit diagram showing a closed condition.

Referring now to FIGS. 2, 7, and 8 of the drawings, it can be seen that leads from battery 35 are connected to two stationary contact plates 54 and 55 and, likewise, leads from battery 36 are connected to two stationary contact plates 56 and 57. A movable circuit breaker plate 58 is positioned between the two pairs of stationary contacts and has two contacts 61 and 62 thereon. One lead from squib 37 is connected to stationary contact 55 and the other lead from squib 37 is connected to contact 61 on circuit breaker plate 58. Likewise, one lead from squib 38 is connected to stationary contact 57 and the other lead from squib 38 is connected to contact 62 on circuit breaker plate 58. As best shown in FIGS. 2 and 7, a metallic spring 63 is positioned between contacts 55 and 61 and thus shorts the leads of squib 37. Likewise, a metallic spring 64 is positioned between contacts 57 and 62 and thus shorts the leads of squib 38. As shown in FIG. 8, however, when circuit breaker plate 58 moves so that contacts 61 and 62 engage contact plates 54 and 56, respectively, springs 63 and 64 are not of sufficient length to engage both the stationary contacts and the contacts on breaker plate 58 and thus springs 63 and 64 no longer short the leads of squibs 37 and 38.

A spring 65 is used for moving circuit breaker plate 58 so that contacts 61 and 62 can engage contacts 54 and 56, respectively, however, movement of circuit breaker plate 58 is prevented by a pair of stop pins 66 and 68 that engage valve 41. Springs 67 and 69 surround stop pins 66 and 68, respectively, and provide forces for opening valve 41 when signaling device 11 reaches the surface.

OPERATION

FIG. 2 of the drawing, shows the signaling device 11 is a "SAFE" position with plastic cover 14 in position to prevent movement of trip lever 15. Valve 41 closes opening 39 and valve 41, in turn, is locked by collar 42, spring 43 and slider 45. Slider 45, in turn, is locked by U-shaped latch 49. Stop pins 66 and 68 are positioned between valve 41 and circuit breaker plate 58 and stop pins 66 and 68 are of sufficient length to separate contacts 61 and 62 from contacts 54 and 56, respectively. Thus it can be seen that batteries 35 and 36 are not electrically connected with squibs 37 and 38. In addition, spring 63 engages contacts 55 and 61 and shorts the leads of squib 37 and, likewise, spring 64 engages contacts 57 and 62 and shorts the leads of squib 38.

Figure 5:
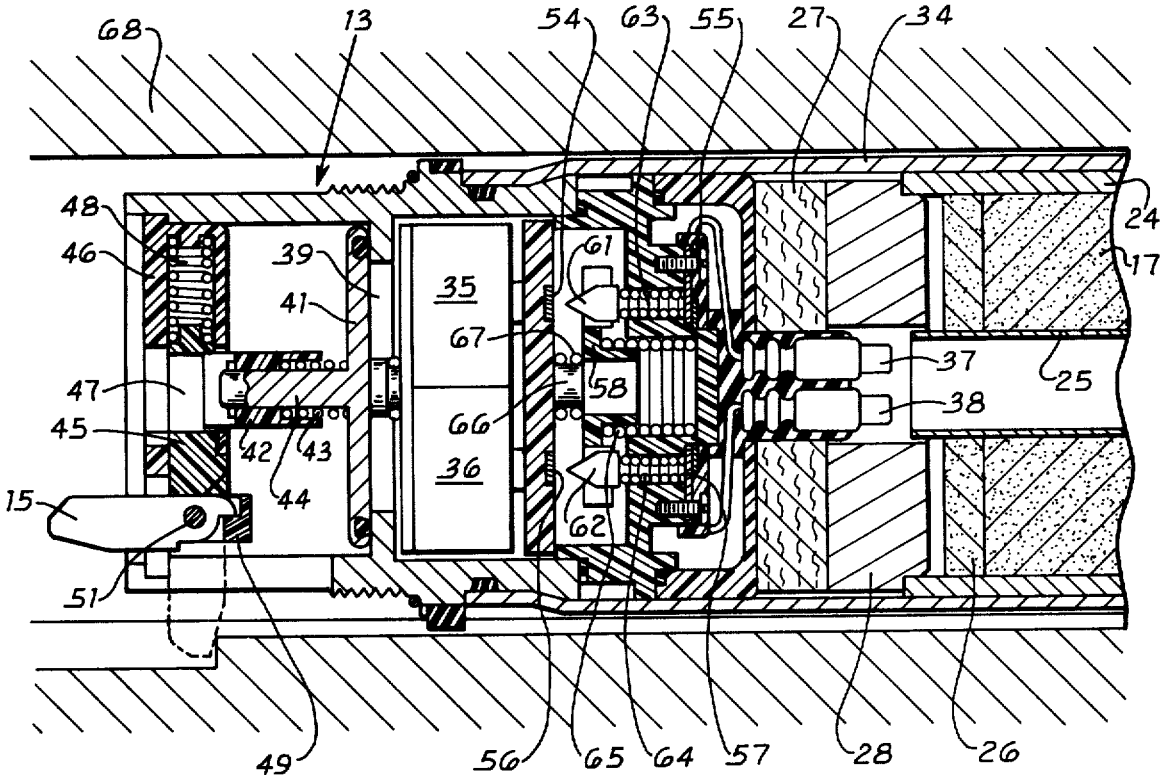
FIG. 5 is a partial sectional view showing a signaling device being launched.

Prior to launch, plastic cover 14 is removed and spring 53 causes trip lever 15 to pivot to an extended position as shown in FIGS. 3 and 4 of the drawings. Upon launching, launcher 68 trips lever 15 which pivots U-shaped latch 49 thereby permitting spring 48 to move slider 45 so that hole 47 is aligned with collar 42. As best shown in FIG. 5 of the drawings, spring 43 moves collar 42 into hole 47 and all mechanical pressure is removed from valve 41. Water pressure, however, is sufficient to keep valve 41 closed and batteries 35 and 36 are not energized.

Figure 6:
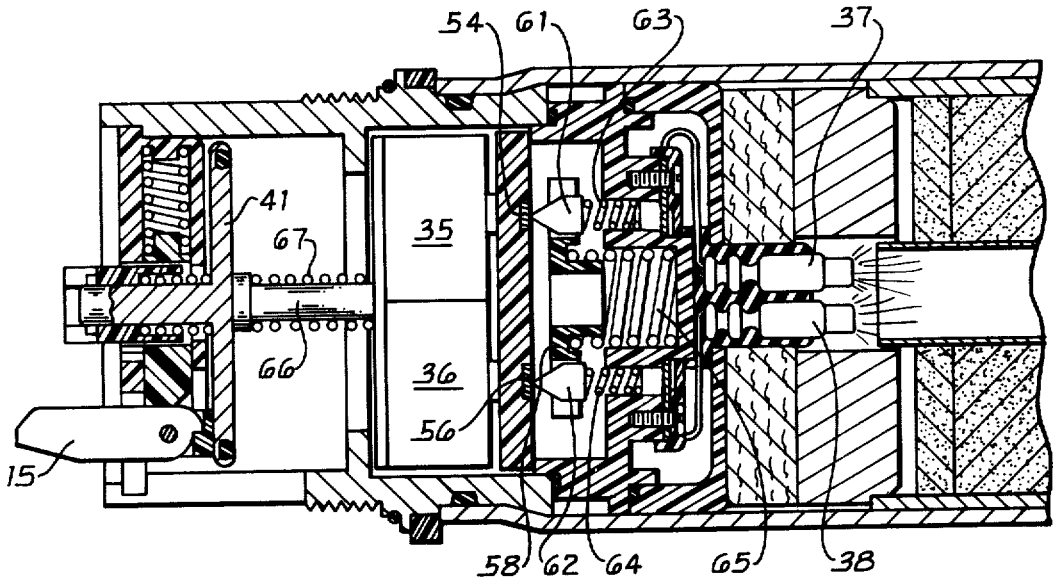
FIG. 6 is a partial sectional view showing a signaling device being ignited.

As signaling device 11 rises, the ambient sea pressure is reduced and when sinaling device 11 nears the surface, the forces applied by springs 67 and 69 which surround stop pins 66 and 68, respectively becomes greater than the ambient sea pressure and as shown in FIG. 6 of the drawings, valve 41 opens thereby flooding the battery compartment and sea water acts as an electrolyte to energize the plates of batteries 35 and 36. Movement of stop pins 66 and 68 allow spring 65 to move circuit breaker plate 58 so that springs 63 and 64 no longer short squibs 37 and 38 and then contact 61 engages contact plate 54 to electrically connect squib 37 with battery 35 and, likewise, contact 62 engages contact plate 56 and electrically connects squib 38 with battery 36. The voltages applied by batteries 35 and 36 detonates squibs 37 and 38, and the heat and flame from these squibs passes through center tube 25 and ignites ignition disk 19 which, in turn, ignites smoke composition 16. The burning of composition 16 increases the internal pressure within signaling device 11 and nose plug 31 is ejected. Smoke then passes through chimney 33 and out of orifice 29. When composition 16 is about consumed, transfer composition 18 is ignited and ignites, in turn, flare composition 17. Thus it can be seen that signaling device 11 can be used during both day and night operations.

The present invention provides an improved submarine signal fuze which can be launched from various depths and, upon reaching the surface of the water, batteries are energized by sea water and detonates squibs which ignite a smoke composition. The opening of a valve to allow water to enter and energize a battery also initiates circuitry which electrically connects the batteries with the squibs and, simultaneously, removes shorts from the squib leads.

Obviously many modifications and variations of the present invention are possible in the light of the above teachings. For example, one pyrotechnic composition might be used instead of the two different compositions and also, one battery and one squib might be used to ignite the ignition disk. It is therefore to be understood that the invention may be practiced otherwise than as specifically described.

We claim:

1. A signaling device adapted to be launched in a body of sea water beneath the surface thereof comprising, a fuze body having an inner chamber, and an aperture communicating therewith, a projectile shell attached to said fuze body and containing a pyrotechnic composition therein, at least one electrical squib having first and second leads for igniting said pyrotechnic composition when said squib is energized, at least one sea water battery having output terminals and being positioned in said inner chamber, valve means in said fuze body normally closing said aperture communicating with said inner chamber of said fuze body from said body of sea water, a latching assembly for locking said valve means in a closed position prior to launching said signling device, first and second spaced apart stationary electrical contacts, a movable breaker plate, at least one contact attached to said movable breaker plate, first circuit means connecting one battery output with said first stationary electrical contact and second circuit means connecting the other battery output with said second stationary electrical contact, third circuit means connecting one squib lead to said second stationary electrical contacts and fourth circuit means connecting the other squib lead with said contact attached to said movable breaker plate, means for moving said movalbe breaker plate whereby said at least one contact attached to said movable breaker plate is engageable with said first stationary electrical contact to connect said sea water battery with said squib, stop means for preventing movement of said circuit breaker plate when said valve means is closing said aperture, and a coil spring engageable with said second stationary contact and with said contact on said movable breaker plate for shorting said first and second squib leads, said coil spring being insufficient in length to contact both said second stationary contact and said contact on said movable breaker plate when said contact on said movable breaker plate engages said first stationary contact.

2. A signaling device adapted to be launched in a body of sea water beneath the surface thereof as set forth in claim 1 wherein said fuze body has an aperture communicating with said inner chamber and said valve means includes a flat disk constructed and arranged to close said aperture by ambient sea pressure.

3. A signaling device adapted to be launched in a body of sea water beneath the surface thereof as set forth in claim 2 wherein said stop means is engageable with said flat disk whereby movement of said flat disk permits movement of said stop means and said movable circuit breaker means adopts a closed circuit position.

* * * * *